US008199178B1

(12) United States Patent
Payne

(10) Patent No.: US 8,199,178 B1
(45) Date of Patent: Jun. 12, 2012

(54) LINEAR ARRAY OF TWO DIMENSIONAL DENSE-PACKED SPATIAL LIGHT MODULATOR

(75) Inventor: Alexander Payne, Ben Lomond, CA (US)

(73) Assignee: Silicon Light Machines Corporation, Sunnyvale, CA (US)

( * ) Notice: Subject to any disclaimer, the term of this patent is extended or adjusted under 35 U.S.C. 154(b) by 1008 days.

(21) Appl. No.: 12/151,189

(22) Filed: May 5, 2008

Related U.S. Application Data

(60) Provisional application No. 60/927,472, filed on May 3, 2007.

(51) Int. Cl.
*B41J 2/47* (2006.01)

(52) U.S. Cl. ..... 347/239; 347/255

(58) Field of Classification Search ..... 347/145, 347/239, 255, 237, 247
See application file for complete search history.

(56) References Cited

U.S. PATENT DOCUMENTS 5,457,566 A * 10/1995 Sampsell et al. ..... 359/292
6,552,777 B2 * 4/2003 Sunagawa ..... 355/67
7,064,883 B2 * 6/2006 Payne et al. ..... 359/290

* cited by examiner

*Primary Examiner* — Hai C Pham
(74) *Attorney, Agent, or Firm* — William E. Nuttle

(57) ABSTRACT

A linear dense-packed spatial light modulator (LDSLM) and method of modulating light using the same are provided. In one embodiment, the LDSLM comprises a plurality of two dimensional (2D) modulators grouped proximal to one another on a surface of a substrate to form a densely-packed, linear array having a plurality of pixels along a longitudinal axis of the array. Each pixel includes a number of 2D modulators electrically coupled to receive a common drive signal and to modulate light reflected therefrom in response to the drive signal. Preferably, each pixel includes at least two 2D modulators grouped along a transverse axis of the array. More preferably, the number of 2D modulators along the transverse axis in each pixel is selected to provide a desired power density while avoiding an undesired thermal gradient across the LDSLM. The LDSLM and method are particularly useful in printing applications. Other embodiments are also disclosed.

20 Claims, 7 Drawing Sheets

LINEAR ARRAY OF TWO DIMENSIONAL DENSE-PACKED SPATIAL LIGHT MODULATOR

CROSS-REFERENCE TO RELATED APPLICATIONS

The present application claims the benefit of priority under 35 U.S.C. 119(e) to U.S. Provisional Patent Application Ser. No. 60/927,472, entitled "Linear Array with Two Dimensional Dense-Packed Modulator," filed May 3, 2007, which application is hereby incorporated by reference in its entirety.

TECHNICAL FIELD

The present invention relates generally to diffractive spatial light modulators and more particularly to a linear array of densely packed, two dimensional, diffractive spatial light modulators.

BACKGROUND OF THE INVENTION

Spatial light modulators are arrays of one or more devices that can control or modulate an incident beam of light in a spatial pattern that corresponds to an electrical input to the devices. The incident light beam, typically generated by a laser, can be modulated in intensity, phase, polarization or direction. Some modulation can be accomplished through the use of Micro-Electromechanical System devices or MEMs that use electrical signals to move micromechanical structures to modulate light incident thereon. Spatial light modulators are increasingly being developed for use in various applications, including display systems, optical information processing and data storage, printing, and maskless lithography.

FIG. 1 shows a linear (1-dimensional) array 100 of a number of ribbon-type spatial light modulators (SLM 102) or diffractors. Generally, each SLM 102 consists of a number of active (movable) ribbons are interlaced or paired with a number of static bias ribbons. By displacing the active ribbons by a quarter wavelength ($\lambda/4$) relative to the static ribbons light reflected from the active ribbons interferes with that reflected from the static ribbons, and a square-well diffraction grating is formed along the long axis of the array 100. In the embodiment shown, several ribbon pairs are ganged under action of a single channel driver 104 to form a single MEMS pixel 106. By assembling a large number of MEMS pixels 106 and drivers 104, a continuous, programmable diffraction grating results, such as is particularly useful in printing and lithography applications.

A schematic side view of a deflected active ribbon of the SLM 102 of FIG. 1A is shown in FIG. 1B. Referring to FIG. 1B, one shortcoming of existing ribbon-type SLMs 102 is that when a potential difference is applied between an active ribbon 108 and substrate (not shown) the active ribbon is deflected into a parabolic profile as shown. As a result the square-well diffraction grating is established only in a narrow region near the center-line of the array 100 that is truly displaced by a $\lambda/4$. Regions outside this optical "sweet-spot" are neither parallel to the surface of the SLM array 100 nor displaced by $\lambda/4$ and therefore cannot provide the desired high contrast and high efficiency modulation. For this reason, illumination onto the standard ribbon-type SLM array 100 must be carefully shaped or focused into a line of illumination 110 using, for example, a Powell Lens. A typical rule of thumb is that the width (W) of the illumination 110 should be no more than about a tenth ($1/10^{th}$) of a length (L) of the ribbon 108.

The need to concentrate the illumination along a narrow line in the middle of the array 110 leads to a number of problems. First, as noted above because of the limited "sweet-spot" of the ribbon-type SLMs 102 sufficient contrast is only achieved when the width of the line illumination 110 is an order of magnitude less than the length of the ribbon 108, and the line illumination is precisely located in the middle of the array 100. If the illumination 110 line-width is too large, or misaligned relative to the array 100, contrast as well as the modulation efficiency will be severely reduced. Thus, the complexity and cost of a SLM array 100 using this approach is greatly increased by the need for additional optics, i.e., the Powell Lens, and the need for a mechanism and procedures to precisely align the illumination 110 relative to the array.

A second and more fundamental problem with this approach is that line-illumination concentrates laser power in a thin line having a high power-density, and creating a thermal knife-edge resulting in enormous thermal gradients in the ribbons 108 of the SLM 102. Moreover, as power density is pushed higher in many applications, such as in Computer Thermal Printing (CTP) applications, in an effort to increase throughput, these thermal gradients continue to increase to the point where the ribbons 108 begin to fail. Typically, the failure mode the ribbons 108 is the "Soret effect" in which atoms of a reflective metal, such as aluminum, covering the ribbons physically migrate 'downhill' along the thermal gradient from a hotter to a cooler region of the ribbon. This migration of metal atoms can reduce the reflection and hence the efficiency of the SLM array 100, and ultimately shortens useful device life.

Accordingly, there is a need for a new SLM and method of operating the same to provide a programmable diffraction grating without the need for additional, linear illumination optics, and the need for a complex alignment mechanism and/or procedures. It is further desirable that the SLM and method are capable of handling increased illumination (laser) power levels without resulting in extreme thermal gradients that reduce the efficiency and limit the life of the SLM.

SUMMARY OF THE INVENTION

The present invention provides a solution to these and other problems, and offers further advantages over conventional arrays of spatial light modulators.

In one aspect, the present invention is directed to a linear dense-packed spatial light modulator (LDSLM) including a plurality of two dimensional (2D) modulators grouped proximal to one another on a surface of a substrate to form a linear array having a plurality of pixels along a longitudinal axis of the array. Each pixel includes a number of 2D modulators electrically coupled to receive a common drive signal and to modulate light reflected therefrom in response to the drive signal. Preferably, each pixel includes at least two 2D modulators grouped along a transverse axis, perpendicular to the longitudinal axis of the array and parallel to the surface of the substrate. More preferably, the number of 2D modulators along the transverse axis each pixel is selected to provide a desired power density while avoiding an undesired thermal gradient across the LDSLM.

Generally, each of the 2D modulators include: (i) a tent member disposed above the upper surface of the substrate in spaced apart relation thereto and having a first planar light reflective surface formed on its upper side facing away from the upper surface of the substrate, the first planar light reflective surface having an aperture formed therein; (ii) a movable actuator disposed between the upper surface of the substrate and the first planar light reflective surface, the movable actuator having a second planar light reflective surface parallel to the first planar light reflective surface and positioned relative to the aperture to receive light passing there through; and (iii) an actuator electrode to generate an electrostatic force between one of a number of drive electrodes on the surface of the substrate and the movable actuator in response to the drive signal received by the 2D modulator to move the movable actuator relative to first planar light reflective surface of the tent member while maintaining the second planar light reflective surface substantially parallel to the first planar light reflective surface. Preferably, the aperture is sized and shaped to define an area substantially equal to an area of the first planar light reflective surface surrounding the aperture. More preferably, the movable actuator is configured to move the second planar light reflective surface relative to the first planar light reflective surface by a distance substantially equal to a multiple of $\lambda/4$ wavelength, where $\lambda$ is a wavelength of light incident on the first and second planar light reflective surfaces.

In certain embodiments, the plurality of pixels are controlled to enable phase and/or magnitude of light reflected from the LDSLM to be independently modulated.

The LDSLM is particularly suitable for use in printing systems requiring higher power densities, such as Computer Thermal Printing (CTP) applications and in maskless photolithography or lithography systems for fabricating microelectronic devices. Thus, in another aspect the invention is directed to a printing system including the above LDSLM. Generally, the system further includes: (i) illumination optics for focusing light onto the linear array of densely-packed 2D modulators; and (ii) imaging optics disposed in a light path between the array and an image plane to image a modulated light beam reflected from the array to a substantially linear portion of the image plane.

In yet another aspect, the invention is directed to method of printing light using the printing system described above. Generally, the method includes the steps of: (i) illuminating a linear dense-packed spatial light modulator (LDSLM) including a plurality of two dimensional (2D) modulators grouped proximal to one another on a surface of a substrate to form a linear array having a plurality of pixels along a longitudinal axis thereof, each pixel including a number of 2D modulators electrically coupled to receive a common drive signal; (ii) modulating light reflected from the LDSLM in response to drive signals received by the number 2D modulators in each pixel; and (iii) projecting the modulated light onto a substantially linear portion of an image plane.

In one embodiment, each of the 2D modulators include a first planar light reflective surface having an aperture formed therein, and a second planar light reflective surface parallel to the first planar light reflective surface and positioned relative to the aperture to receive light passing therethrough, and the step of modulating light reflected from the SLM includes moving the second planar light reflective surface relative to the first planar light reflective surface while maintaining the second planar light reflective surface substantially parallel to the first planar light reflective surface. Generally, the aperture is sized and shaped to define an area substantially equal to an area of the first planar light reflective surface surrounding the aperture.

Preferably, the step of modulating light reflected from the LDSLM includes moving the second planar light reflective surface relative to the first planar light reflective surface by a distance substantially equal to a multiple of $\lambda/4$ wavelength, where $\lambda$ is a wavelength of light incident on the first and second planar light reflective surfaces. More preferably, the step of modulating light reflected from the LDSLM includes the step of diffracting light reflected from the first planar light reflective surface and light the second planar light reflective surface of at least one of the plurality of 2D modulators.

BRIEF DESCRIPTION OF THE DRAWINGS

These and various other features and advantages of the present invention will be apparent upon reading of the following detailed description in conjunction with the accompanying drawings and the appended claims provided below, where:

DETAILED DESCRIPTION

The present invention is directed to spatial light modulators (SLMs) and light modulating systems including a linear array of two dimensional dense-packed modulators or a linear dense-packed SLM (LDSLM) and methods of using the same.

The LDSLM and method of the invention are useful in displays, optical information processing, data storage and printing. The LDSLM is particularly suitable for use in printing systems requiring higher power densities, such as Computer Thermal Printing (CTP) applications and in maskless photolithography or lithography systems for fabricating micro-electronic devices.

In the following description, for purposes of explanation, numerous specific details are set forth in order to provide a thorough understanding of the present invention. It will be evident, however, to one skilled in the art that the present invention may be practiced without these specific details. In other instances, well-known structures, and techniques are not shown in detail or are shown in block diagram form in order to avoid unnecessarily obscuring an understanding of this description.

Reference in the description to "one embodiment" or "an embodiment" means that a particular feature, structure, or characteristic described in connection with the embodiment is included in at least one embodiment of the invention. The appearances of the phrase "in one embodiment" in various places in the specification do not necessarily all refer to the same embodiment. The term "to couple" as used herein may include both to directly connect and to indirectly connect through one or more intervening components.

Figure 1A:
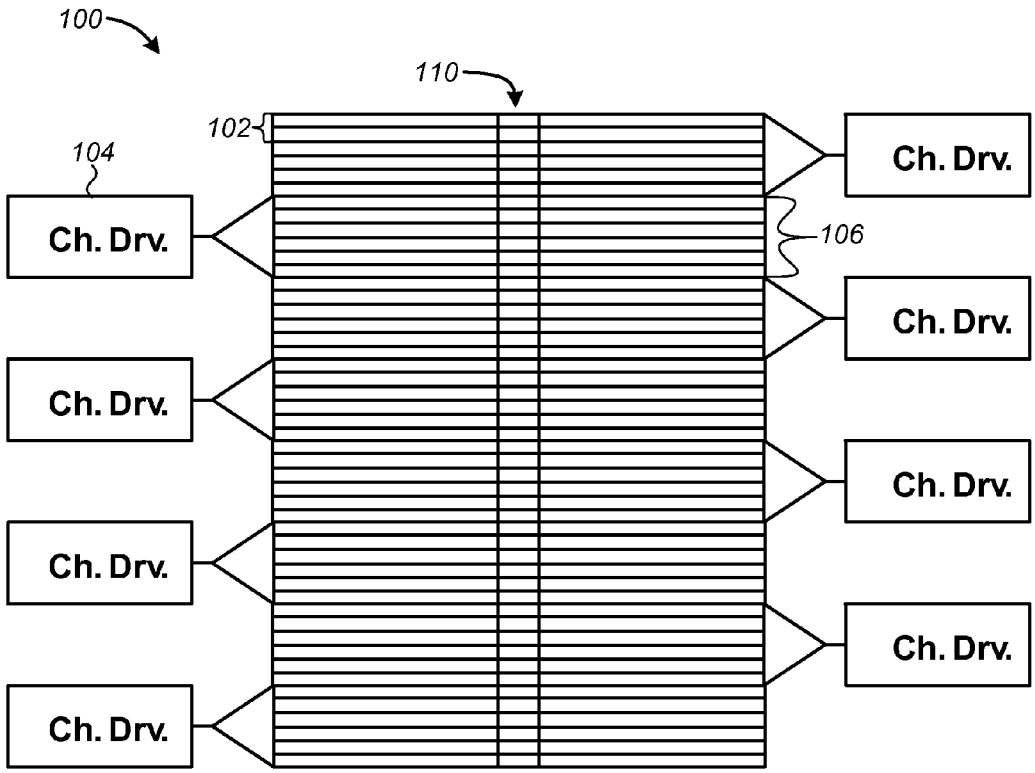
FIG. 1A (Prior Art)
FIG. 1A is a schematic block diagram of a planar top view of a conventional ribbon-type spatial light modulator (SLM)
Figure 1B:
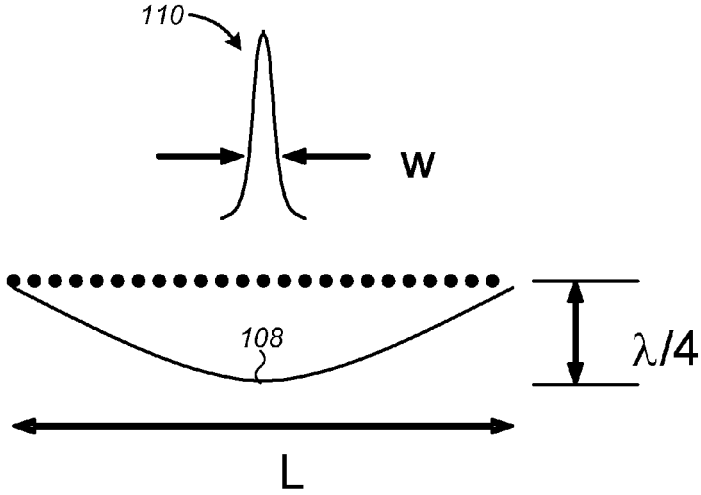
FIG. 1B (Prior Art)
FIG. 1B is a schematic sectional side view of a deflected active ribbon of the SLM of FIG. 1A.
Figure 2:
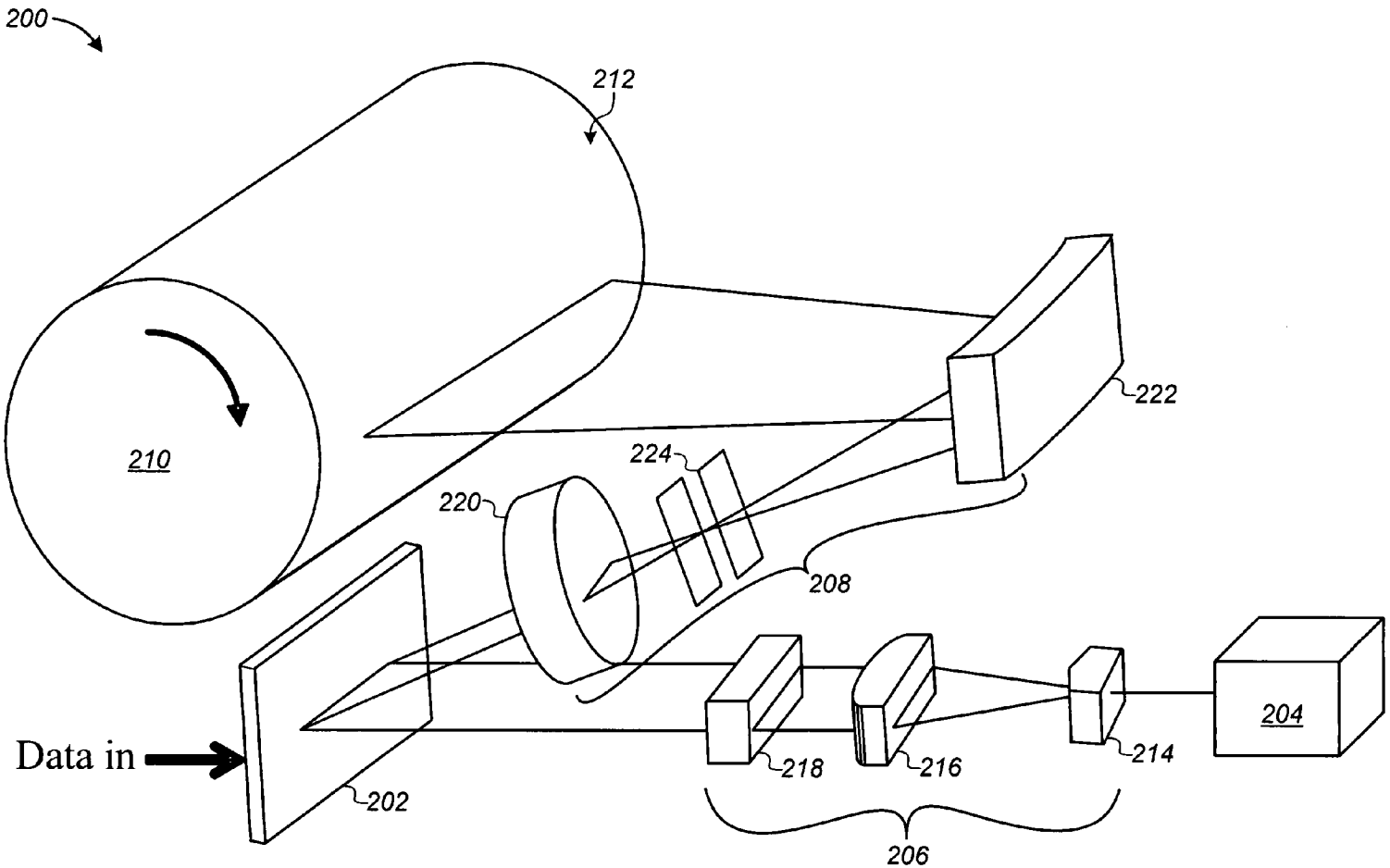
FIG. 2 is a schematic block diagram of a layout for a printing system including a linear dense-packed SLM (LDSLM) assembly according an embodiment of the present invention.

Architecture for a printing system or printer 200 including a LDSLM assembly 202 according to an embodiment of the present invention is shown in FIG. 2. An advantage of using a LDSLM in this application is that it eliminates the need for a scanning mirror and f-θ or scanning optics of conventional SLM by replacing them with a LDSLM assembly 202 sufficiently large along a longitudinal axis to project modulated light over a swath extending substantially across the entire width of an imaging plane. Referring to FIG. 2, the printer 200 generally comprises an illuminator or light source 204, illumination optics 206, and imaging optics 208 to direct an image (modulated light) from the LDSLM assembly 202 onto a photosensitive or photoconductive surface of the imaging plane, shown here as a drum 210 with a photoconductive layer on a surface 212 thereof.

The light source 204 can include any light emitting device capable of continuously emitting light at a sufficient power level or power density, and, preferably at a single or narrow range of wavelengths to enable light reflected from diffractors of the LDSLM assembly 202 to be modulated in phase and/or amplitude by diffraction. In certain printing applications, and in particular in photothermal printers, the light source 204 can include a number of lasers or laser emitters, such as diode lasers, each powered from a common power supply (not shown) in a CW (Continuous Wave) operation. Preferably, the light source 204 is a high-power diode laser producing from about 5000 to about 40,000 milliwatts (mW) of power at a wavelength (λ) of from about 750 to about 1000 nm.

The illumination optics 206 can comprise a number of elements including lens integrators, mirrors and prisms, designed to transfer light from the light source 204 to the LDSLM assembly 202 such that a line of a specified length and width is illuminated on the LDSLM. In the embodiment shown, the illumination optics 206 include a prism 214 and lens 216 to refract and transmit light from the light source 204, and an integrator 218 to illuminate a swath covering substantially the full width of the LDSLM.

The imaging optics 208 can include magnification elements, such as a Fourier Transform (FT) lens 220 and a FT mirror 222, to direct the light from the LDSLM assembly 202 to the photoconductive layer located on the drum 210. Preferably, the imaging optics 208 is designed to transfer light from the LDSLM assembly 202 to the drum 210 such that a photoconductive layer located on the drum is illuminated across a swath covering substantially the full width of the drum. Optionally, as in the embodiment shown, the imaging optics 208 further includes filter elements, such as a FT filter 224, to resolve light reflected from each pixel but not light reflected from each individual modulator or diffractor or from each element in each modulator.

In accordance with the present invention, and as described in detail below, the LDSLM assembly 202 includes a linear array of a number of individual diffractive two-dimensional (2D) densely packed spatial light modulators or diffractors (not shown in this figure). Adjacent 2D modulators may be grouped or functionally linked to provide a number of pixels in the linear array that can be controlled by drive signals from a single, common drive channel to print to the imaging plane with a desired resolution. Preferably, the LDSLM assembly 202 has a pixel count adequate to cover a swath or strip extending substantially across the entire width of the photo or thermal-sensitive surface of the imaging plane. More preferably, the LDSLM assembly 202 has a pixel count of at least about 500 pixels, and most preferably of at least about 1000 pixels to provide the desired resolution. For example, in one version of the layout illustrated in FIG. 2, the LDSLM assembly 202 includes a sufficient number of pixels to cover an entire swath on a standard eight inch (8") write drum 210 with a printing resolution of about 2000 dots-per-inch (dpi) using a modest-power, 780 nm GaAs diode laser as the light source 204.

In another embodiment, not shown, the printing system is a maskless lithography or photolithography system including the LDSLM and further comprising a pattern generator to generate and transmit to the number of 2D modulators drive signals to manufacture micro-electronic devices. By micro-electronic devices it is meant integrated circuits (ICs) and Micro-Electromechanical System or MEMs devices. In maskless lithography, light used to expose the photosensitive material in an image plane on a substrate, such as silicon or semiconductor wafer, on which the device is to be formed. Some embodiments of 2D modulator arrays suitable for use in the LDSLM of the present invention will now be described with reference to FIGS. 3A through 3C. For purposes of clarity, many of the details of 2D modulators and methods of forming the same that are not relevant to the present invention have been omitted from the following description. Two dimensional spatial light modulators are described in more detail in, for example, commonly assigned U.S. Pat. No. 7,064,883 to Payne et al., entitled "Two dimensional spatial light modulator," which application is hereby incorporated by reference in its entirety.

Figure 3A:
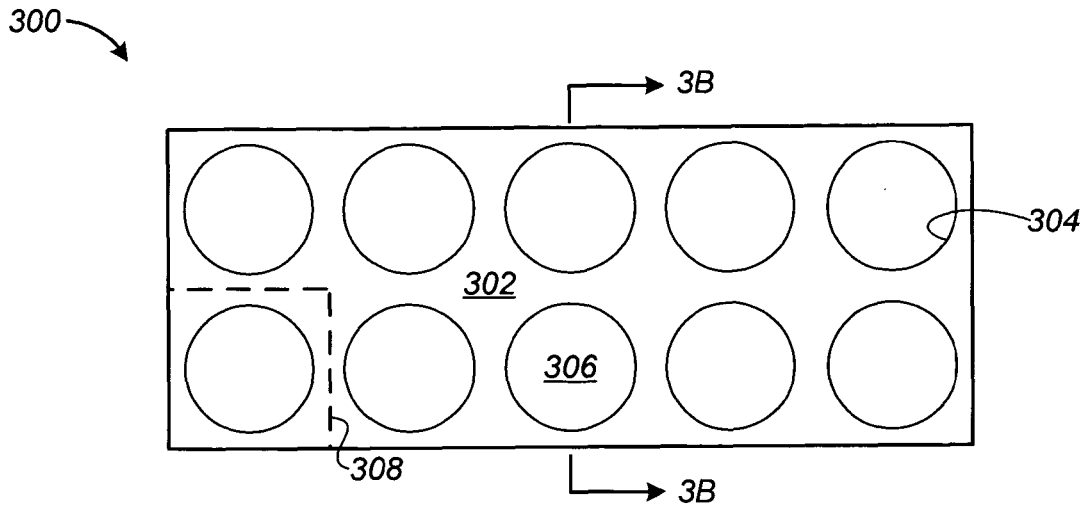
FIG. 3A is a schematic block diagram of a planar top view of a portion of an array of dense-packed, two-dimensional (2D) modulators according to an embodiment of the present invention.

FIG. 3A is a plan view of a portion of an array 300 of dense-packed, two-dimensional (2D) modulators. The array 300 generally has two films or membranes having light reflecting surfaces of equal area and reflectivity disposed above an upper surface of a substrate (not shown in this figure). The topmost film is a static tent membrane or member 302 of a uniform, planar sheet of a material having a first planar light reflective surface, for example taut silicon-nitride covered on at least one side with an aluminized surface. The tent member 302 has an array of apertures 304 extending from the top reflective surface of the member to a lower surface (not shown). The tent member 302 covers an actuator membrane underneath. The actuator membrane includes a number of flat, displaceable or movable actuators 306. The actuators 306 have second planar light reflective surfaces parallel to the first planar light reflective surface of the tent member 302 and positioned relative to the apertures 304 to receive light passing therethrough. Each of the actuators 306, the associated apertures 304 and a portion of the tent member 302 immediately adjacent to and enclosing the aperture form a single, individual modulator 308 or diffractor. The size and position of each of the apertures 304 are chosen to satisfy an "equal reflectivity" constraint. That is the area of the second reflective surface exposed by a single aperture 304 inside is substantially equal to the reflectivity of the area of the individual modulator 308 outside the aperture 304.

Figure 3B:
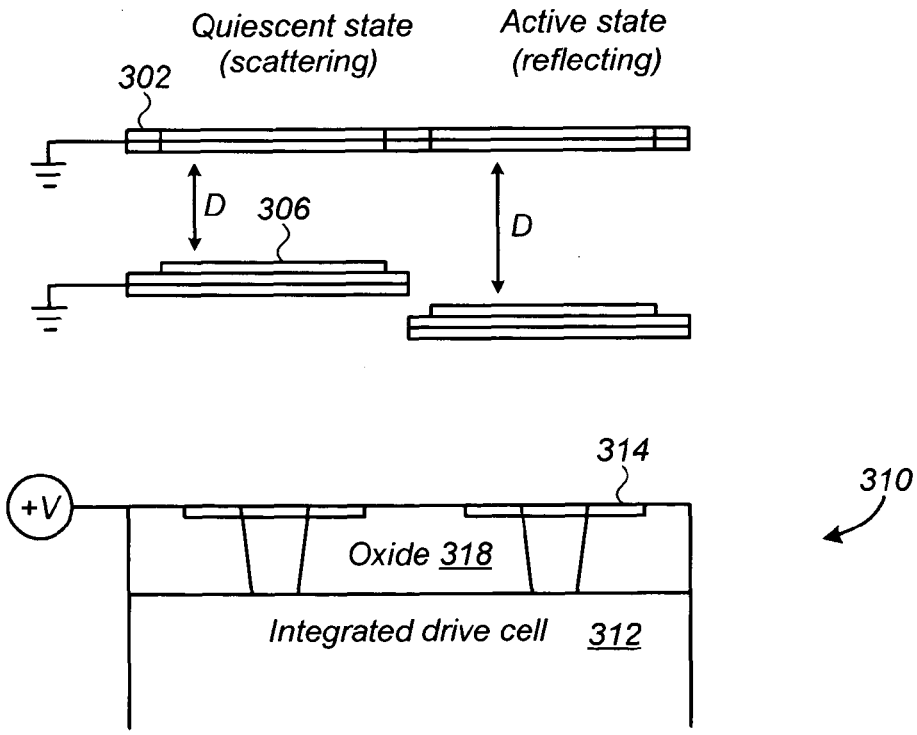
FIG. 3B is a schematic sectional side view of two adjacent modulators of the array of FIG. 3A.

FIG. 3B depicts a cross-section through two adjacent modulators 308 of the array 300 of FIG. 3A. In this exemplary embodiment, the upper tent member 302 remains static, while the lower actuator membrane or actuators 306 move under electrostatic forces from integrated electronics or drive circuitry in the substrate 310. The drive circuitry generally includes an integrated drive cell 312 coupled to substrate or drive electrodes 314 via interconnect 316. An oxide 318 may be used to electrically isolate the electrodes 314. The drive circuitry is configured to generate an electrostatic force between each electrode 314 and its corresponding actuator 306.

Individual actuators 306 or groups of actuators are moved up or down over a very small distance (typically only a fraction of the wavelength of light incident on the array 300) relative to first planar light reflective surface of the tent member 302 by electrostatic forces controlled by drive electrodes 314 in the substrate 310 underlying the actuators 306. Preferably, the actuators 306 can be displaced by $n*\lambda/4$ wavelength, where $\lambda$ is a particular wavelength of light incident on the first and second planar light reflective surfaces, and n is an integer equal to or greater than 0. Moving the actuators 306 brings reflected light from the second planar light reflective surface into constructive or destructive interference with light reflected by the first planar light reflective surface (i.e., the tent member 302), thereby modulating light incident on the array 300.

For example, in one embodiment of the array 300 shown in FIG. 3B, the distance (D) between reflective layers of the tent 302 and actuator 306 may be chosen such that, in a non-deflected or quiescent state, the tent member, or more accurately the first reflective surface, and the actuator (second reflective surface), are displaced from one another by an odd multiple of $\lambda/4$, for a particular wavelength $\lambda$, of light incident on the array 300. This causes the array 300 in the quiescent state to scatter incident light, as illustrated by the left actuator of FIG. 3B. In an active state for the array 300, as illustrated by the right actuator of FIG. 3B, the actuator 306 may be displaced such that the distance between the reflective surfaces of the tent member 302 and the actuator 306 is an even multiple of $\lambda/4$ causing the array 300 to reflect incident light.

In an alternative embodiment, not shown, the distance (D) between reflective layers of the tent 302 and actuator 306 can be chosen such that, in the actuator's quiescent state, the first and second reflective surfaces are displaced from one another by an even multiple of $\lambda/4$, such that the array 300 in quiescent state is reflecting, and in an active state, as illustrated by the right actuator, the actuator is displaced by an odd multiple of $\lambda/4$ causing it to scatter incident light.

The size and position of each of the apertures 304 are predetermined to satisfy the "equal reflectivity" constraint. That is the reflectivity of the area of a single aperture 304 inside is equal to the reflectivity of the remaining area of the cell that is outside the aperture 304.

Figure 3C:
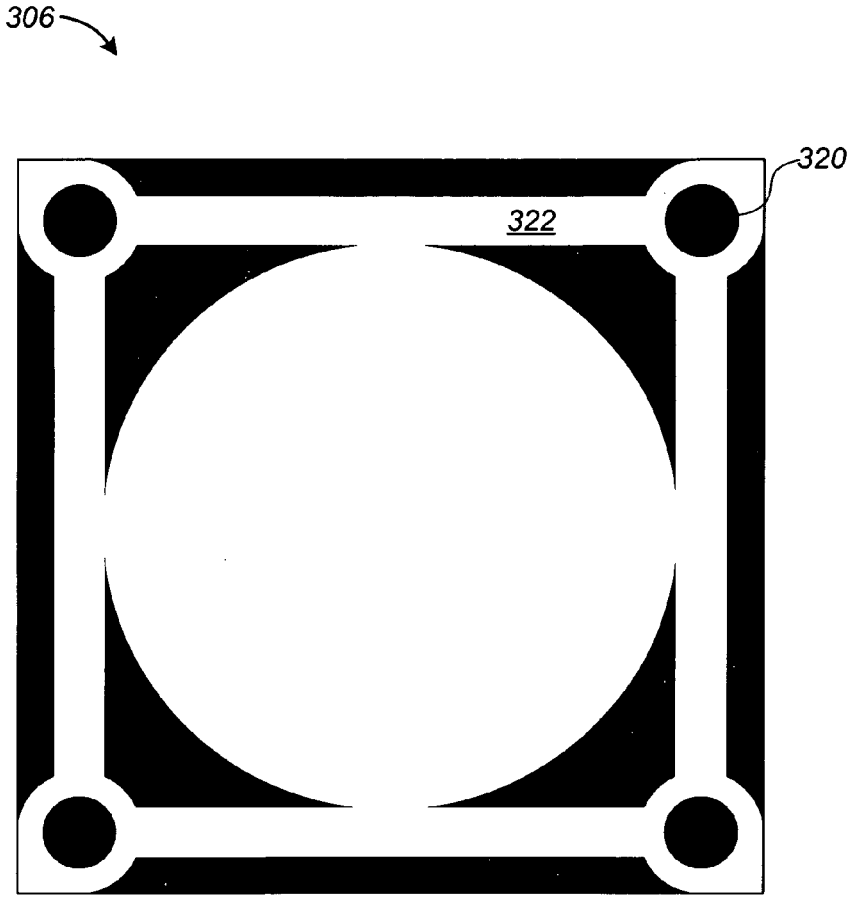
FIG. 3C is a schematic block diagram of an actuator of a single modulator o of the array of FIG. 3A.

A close up planar view of a single actuator is shown in FIG. 3C. Referring to FIG. 3C, the actuator 306 is anchored or posted to the underlying substrate (not shown in this figure) by a number of posts 320 at the corner of each actuator. The actuators 308 include uniform, planar disks each having a planar reflective surface and flexibly coupled by hinges or flexures 322 of an elastic material to one or more of the posts 320. For example, the reflective surfaces the actuators 306 can include aluminized disks attached to a taut silicon-nitride film, and flexibly coupled to the posts by narrow, non-aluminized flexures of the same silicon-nitride film. Anchoring posts 320 and flexures 322 are hidden in the area concealed by the overlying tent member 302, thereby providing the array 300 with a large étendue and substantially 100% diffraction efficiency. The actuator 306 also includes, in addition to the aluminum layer and the silicon-nitride (SiN) layer, an electrically conductive film or layer, such as a titanium-nitride (TiN) layer. The electrically conductive layer is electrically coupled to electrical ground in the substrate through one or more of the posts 320 so that a voltage applied to the drive electrode electrically 314 deflects actuators toward or away from the substrate.

Although the light reflective surface of the actuator 306 is shown and described above as being positioned below the light reflective surface of the tent member 302 and between the first reflective surface and the upper surface of the substrate, it will be appreciated that the light reflective surface of the actuator can alternatively be raised above the movable actuator to be positioned coplanar with or above the light reflective surface of the tent member 302.

Figure 4A:
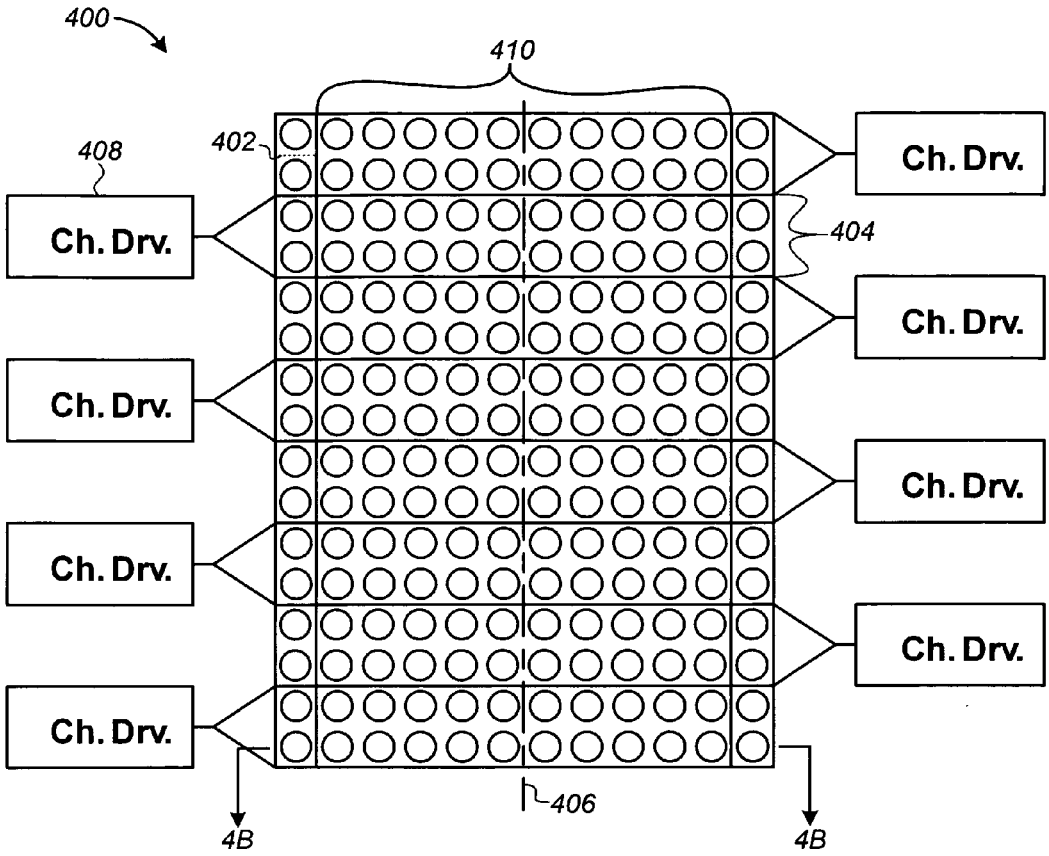
FIG. 4A is a planar top view of an LDSLM according to an embodiment of the present invention.
Figure 4B:
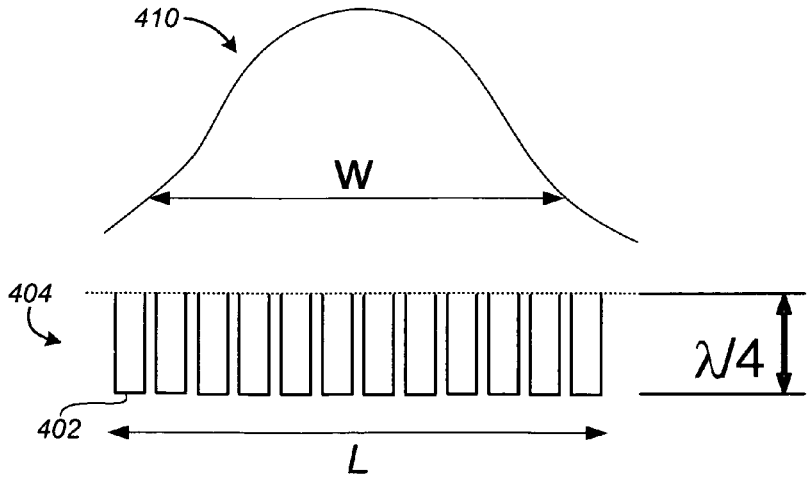
FIG. 4B is a schematic sectional side view of the LDSLM of FIG. 4A.

An exemplary LDSLM 400 comprising a linear array of dense-packed, 2D modulators 402 will now be described with reference to the diagrams of FIGS. 4A and 4B. FIG. 4A is a planar top view of an LDSLM according to an embodiment of the present invention. FIG. 4B illustrates a sectional side view of the LDSLM of FIG. 4A taken along line 4B.

Referring to FIGS. 4A and 4B, in one embodiment the 2D modulators 402 are grouped into a linear array of interleaved channels or pixels 404 along a longitudinal axis 406. Each of the 2D modulators 402 in a single pixel 404 share a common drive channel or channel driver (Ch. Drv. 408). Although in the embodiment shown each pixel 404 is depicted as having 2 rows of 12 modulators grouped along a transverse axis perpendicular to the longitudinal axis of the array, it will be appreciated that each channel or pixel can include any number of 2D modulators arranged in any number of rows of any length across the width or transverse axis of the array without departing from the spirit and scope of the invention. Similarly, the LDSLM 400 can include a linear array of any number of pixels 404 or a number of linear arrays placed end to end. Because each of the 2D modulators 402 in a pixel 404 is deflected by the same amount, optimally a multiple of a quarter wavelength ($\lambda/4$) of the incident light for maximum diffraction, the width (W) of the illuminated portion 410 of the LDSLM 400 can be arbitrarily wide up to or exceeding a length (L) of the pixel 404, with substantially no impact on the contrast or modulation efficiency of the LDSLM.

Preferably, the illumination 410 is shaped or focused to extending substantially uniformly across the length and breadth of the LDSLM 400. The illumination can be shaped or focused into a line of illumination using, for example, a cylindrical aspheric lens having a hyperbolic profile, sometimes called a Powell Lens.

In addition, because input power gradient varies with the square of the illumination width, W, and because a temperature gradient across the LDSLM 400 is proportional to the input power gradient, it is possible to significantly increase the applied illumination or laser power with substantially no damage to the 2D modulators 402 due to the Soret effect, which is driven by temperature gradient.

Figure 5:
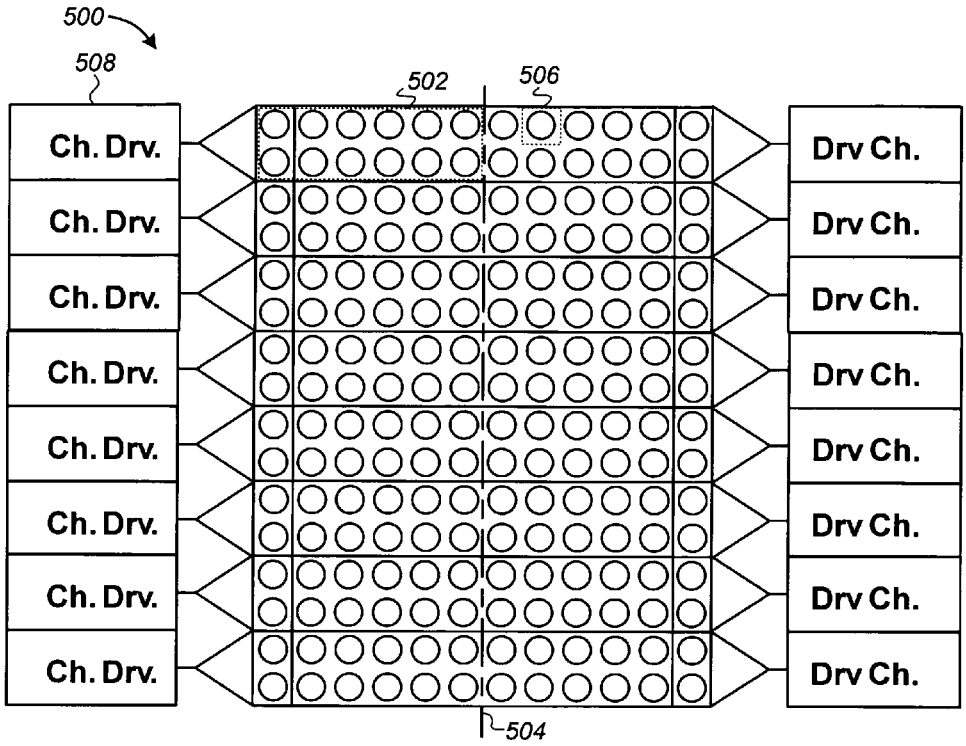
FIG. 5 is a planar top view of an LDSLM according to another embodiment of the present invention.

In another embodiment, shown in FIG. 5, the LDSLM 500 can include one or more sub-pixels or pixels 502 arranged along transverse axes of the array, perpendicular to a longitudinal axis 504 of the array. For example, in FIG. 5, the LDSLM 500 includes a plurality of pixels 502, each pixel including two rows of six modulators 506 on either side of the longitudinal axis 504, driven by separate individual channel driver (Ch. Drv. 508) and extending in a series of pairs the longitudinal axis. It will be appreciated that with an appropriately sized LDSLM 500 this embodiment enables the simultaneous imaging of two or more rows of modulated light across the width of an image plane, thereby increasing imaging speed.

Figure 6:
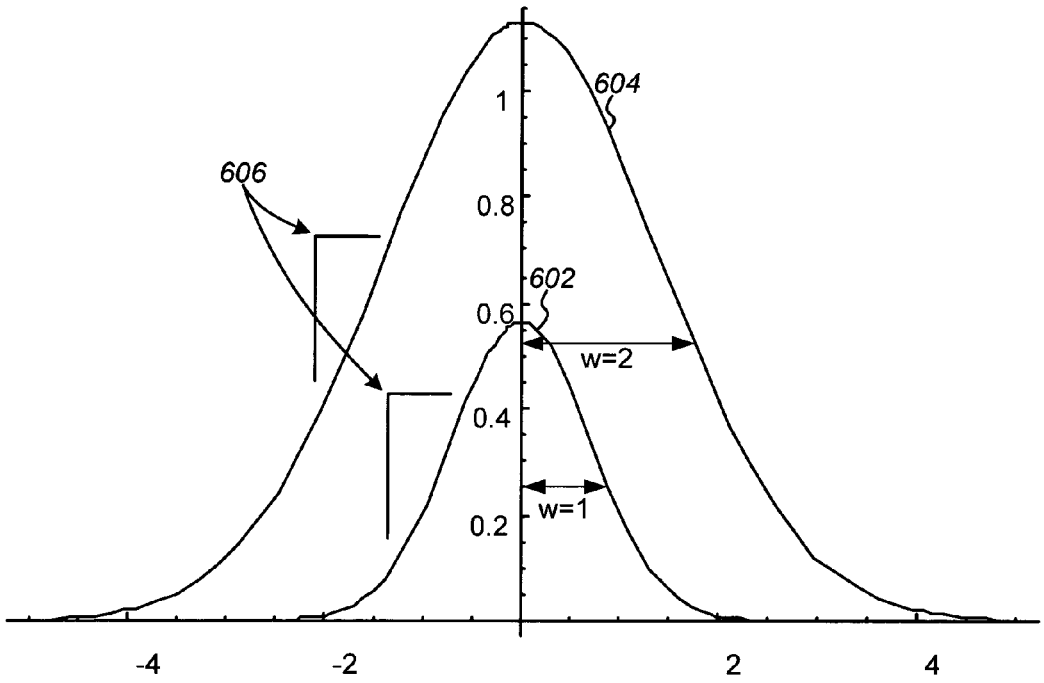
FIG. 6 is a graphical comparison of Gaussian illumination profiles for a ribbon-type SLM and a LDSLM according to an embodiment of the present invention.

A graphical comparison of Gaussian illumination profiles for a ribbon-type SLM and a LDSLM according to an embodiment of the present invention will now be made with reference to FIG. 6. The relationship between a maximum input power gradient of a Gaussian illumination profile and the beam or illumination width, w, is given by the following equation:

$$\left.\frac{dI}{dx}\right|_{max} = \sqrt{\frac{2}{e\pi}} \cdot \frac{P}{w^2}$$

where dI/dx is the input power gradient, I is the beam or illumination intensity, P is the integrated beam power, and w is the beam width. In this figure curve 602 illustrates the Gaussian illumination profile for a ribbon-type SLM and curve 604 illustrates that for a LDSLM. Referring to FIG. 5, the maximum input power gradient of (represented by the slope 606) is inversely proportional to the square of the beam width (w). Thus, if the beam width is doubled (i.e., from w=1 to w=2) the total power of the laser or illumination applied is increased by a factor of four (4×) substantially without increasing the maximum power gradient (slope 606) of the Gaussian illumination profile. In one exemplary embodiment, the width, w, of the illuminated portion of the LDSLM is increased by a factor of five (5) over that of a conventional ribbon-type SLM, increasing total power to the LDSLM by a factor of twenty-five times (25×) without increasing the maximum input power gradient. It will be appreciated by those skilled in the art that such an increase in illumination power can significantly increase the speed of high power printing applications requiring modulation of high levels of laser power, such as in Computer Thermal Printing (CTP) applications.

The advantages of the method of the present invention over previous or conventional SLMs include: (i) improved contrast; and (ii) improved power handling, with substantially no adverse impacts to device speed, operational lifetime or requiring an undesired increase in device size. In addition, it will further be appreciated that the LDSLM having a linear array of densely-packed 2D modulators reduces overall costs by eliminating the need for a complex alignment mechanism and/or procedures.

The foregoing description of specific embodiments and examples of the invention have been presented for the purpose of illustration and description, and although the invention has been described and illustrated by certain of the preceding examples, it is not to be construed as being limited thereby. They are not intended to be exhaustive or to limit the invention to the precise forms disclosed, and many modifications, improvements and variations within the scope of the invention are possible in light of the above teaching. It is intended that the scope of the invention encompass the generic area as herein disclosed, and by the claims appended hereto and their equivalents. The scope of the present invention is defined by the claims, which includes known equivalents and unforeseeable equivalents at the time of filing of this application.

What is claimed is:

1. A linear dense-packed spatial light modulator (LDSLM) comprising a plurality of two dimensional (2D) modulators grouped proximal to one another on a surface of a substrate to form a linear array including a plurality of pixels along a longitudinal axis of the array, each pixel comprising a pair of sub-pixels including a sub-pixel on either side of the longitudinal axis sharing a common transverse axis perpendicular to the longitudinal axis of the array and parallel to the surface of the substrate and electrically coupled to receive a common drive signal and to modulate light reflected therefrom in response to the drive signal.

2. A LDSLM according to claim 1, wherein the substrate comprises a number of drive electrodes on the surface thereof, and wherein each of the 2D modulators comprise:

a tent member disposed above an upper surface of the substrate in spaced apart relation thereto and having a first planar light reflective surface formed on an upper surface facing away from the upper surface of the substrate;

a movable actuator having a second planar light reflective surface parallel to the first planar light reflective surface and positioned so as to receive light passing the first planar light reflective surface; and an actuator electrode to generate an electrostatic force between one of a number of drive electrodes and the movable actuator in response to the drive signal received by the 2D modulator to move the movable actuator relative to first planar light reflective surface of the tent member while maintaining the second planar light reflective surface substantially parallel to the first planar light reflective surface.

3. A LDSLM according to claim 2, wherein the second planar light reflective surface of the movable actuator is sized and shaped to define an area substantially equal to an area of the first planar light reflective surface.

4. A LDSLM according to claim 3, wherein the first planar light reflective surface of the tent member further comprises an aperture formed therein, and wherein the second planar light reflective surface of the movable actuator is positioned between the first reflective surface and the upper surface of the substrate to receive light passing through the aperture.

5. A LDSLM according to claim 3, the second planar light reflective surface of the movable actuator is positioned coplanar with the first planar light reflective surface of the tent member.

6. A LDSLM according to claim 3, wherein the movable actuator is configured to move the second planar light reflective surface relative to the first planar light reflective surface by a distance substantially equal to a multiple of $\lambda/4$ wavelength, where $\lambda$ is a wavelength of light incident on the first and second planar light reflective surfaces.

7. A LDSLM according to claim 1, wherein each sub-pixel in the pair of sub-pixels coupled to receive drive signal from a separate channel driver.

8. A printing system comprising:

a plurality of two dimensional (2D) modulators grouped proximal to one another on a surface of a substrate to form a linear array having a plurality of pixels along a longitudinal axis of the array, each pixel comprising a pair of sub-pixels including a sub-pixel on either side of the longitudinal axis sharing a common transverse axis perpendicular to the longitudinal axis of the array and parallel to the surface of the substrate and each sub-pixel in the pair of sub-pixels electrically coupled to receive a common drive signal from a channel driver;

illumination optics for focusing light into a line of illumination onto the array; and imaging optics disposed in a light path between the array and an image plane to image a modulated light beam reflected from the array to a substantially linear portion of the image plane.

9. A system according to claim 8, wherein the substrate comprises a number of drive electrodes on the surface thereof, and wherein each of the 2D modulators comprise:

a tent member disposed above an upper surface of the substrate in spaced apart relation thereto and having a first planar light reflective surface formed on an upper surface facing away from the upper surface of the substrate;

a movable actuator having a second planar light reflective surface parallel to the first planar light reflective surface and positioned so as to receive light passing the first planar light reflective surface; and an actuator electrode to generate an electrostatic force between one of a number of drive electrodes and the movable actuator in response to the drive signal received by the 2D modulator to move the movable actuator relative to first planar light reflective surface of the tent member while maintaining the second planar light reflective surface substantially parallel to the first planar light reflective surface.

10. A system according to claim 9, wherein the first planar light reflective surface of the tent member further comprises an aperture formed therein, and wherein the second planar light reflective surface of the movable actuator is positioned between the first reflective surface and the upper surface of the substrate to receive light passing through the aperture.

11. A system according to claim 9, the second planar light reflective surface of the movable actuator is positioned coplanar with the first planar light reflective surface of the tent member.

12. A system according to claim 9, wherein the second planar light reflective surface of the movable actuator is sized and shaped to define an area substantially equal to an area of the first planar light reflective surface surrounding it.

13. A system according to claim 12, wherein the movable actuator is configured to move the second planar light reflective surface relative to the first planar light reflective surface by a distance substantially equal to a multiple of $\lambda/4$ wavelength, where $\lambda$ is a wavelength of light incident on the first and second planar light reflective surfaces.

14. A system according to claim 8, wherein the imaging optics does not include scanning optics to scan the modulated light in a direction parallel to the substantially linear portion.

15. A method of printing, comprising the steps of:

illuminating with a line of illumination a spatial light modulator (SLM) including a plurality of two dimensional (2D) modulators grouped proximal to one another on a surface of a substrate to form a linear array having a plurality of pixels along a longitudinal axis thereof, each pixel comprising a pair of sub-pixels including a sub-pixel on either side of the longitudinal axis sharing a common transverse axis perpendicular to the longitudinal axis of the array and parallel to the surface of the substrate and each sub-pixel in the pair of sub-pixels electrically coupled to receive a common drive signal from a channel driver;

modulating light reflected from the SLM in response to drive signals received by the modulators in each pixel; and projecting the modulated light onto a substantially linear portion of an image plane.

16. A method according to claim 15, wherein each of the 2D modulators comprise a first planar light reflective surface and a second planar light reflective surface parallel to the first planar light reflective surface and positioned to receive a portion of the incident light, and wherein the step of modulating light reflected from the SLM comprises moving the second planar light reflective surface relative to the first planar light reflective surface while maintaining the second planar light reflective surface substantially parallel to the first planar light reflective surface.

17. A method according to claim 16, wherein the second planar light reflective surface is sized and shaped to define an area substantially equal to an area of the first planar light reflective surface.

18. A method according to claim 17, wherein the step of modulating light reflected from the SLM comprises moving the second planar light reflective surface relative to the first planar light reflective surface by a distance substantially equal to a multiple of $\lambda/4$ wavelength, where $\lambda$ is a wavelength of light incident on the first and second planar light reflective surfaces.

19. A method according to claim 18, wherein the step of modulating light reflected from the SLM comprises the step of diffracting light reflected from the first planar light reflective surface and light from the second planar light reflective surface of at least one of the plurality of 2D modulators.

20. A method according to claim 15, wherein the step of projecting the modulated light onto a substantially linear portion of an image plane does not include scanning the modulated light in a direction parallel to the substantially linear portion.

* * * * *